US010816309B2

(12) United States Patent
Martindale

(10) Patent No.: US 10,816,309 B2
(45) Date of Patent: Oct. 27, 2020

(54) REAR SIGHT BLOCK AND BARREL FOR A FIREARM

(71) Applicant: David Eugene Martindale, Aurora, CO (US)

(72) Inventor: David Eugene Martindale, Aurora, CO (US)

( * ) Notice: Subject to any disclaimer, the term of this patent is extended or adjusted under 35 U.S.C. 154(b) by 0 days.

(21) Appl. No.: 16/582,737

(22) Filed: Sep. 25, 2019

(65) Prior Publication Data

US 2020/0141701 A1 May 7, 2020

Related U.S. Application Data

(60) Provisional application No. 62/794,153, filed on Jan. 18, 2019, provisional application No. 62/736,364, filed on Sep. 25, 2018.

(51) Int. Cl.

| | |
|---|---|
| ***F41A 21/00*** | (2006.01) |
| ***F41G 11/00*** | (2006.01) |
| ***F41G 1/16*** | (2006.01) |
| ***F41A 21/48*** | (2006.01) |
| *F41A 21/30* | (2006.01) |
| *F41A 21/36* | (2006.01) |

(52) U.S. Cl.

CPC ..... *F41G 11/003* (2013.01); *F41A 21/48* (2013.01); *F41G 1/16* (2013.01); *F41A 21/30* (2013.01); *F41A 21/36* (2013.01)

(58) Field of Classification Search

CPC ..... F41G 11/003; F41G 1/16; F41A 21/48; F41A 21/30; F41A 21/36

USPC ..... 42/78

See application file for complete search history.

(56) References Cited

U.S. PATENT DOCUMENTS

| | | | | |
|---|---|---|---|---|
| 1,388,856 A * | 8/1921 | Fox | F41A 3/26 | 89/152 |
| 8,061,260 B2 * | 11/2011 | Kenney | F41A 5/26 | 89/193 |
| 8,307,750 B2 * | 11/2012 | Vuksanovich | F41A 5/28 | 89/191.01 |

(Continued)

OTHER PUBLICATIONS

B. Keeney, "Rear Sight Tower Anatomy Lesson," retrieved from https://www.youtube.com/watch?v=KP0FGDR...CuA, Occam Defense Solutions Inc., posted Jul. 25, 2017.

(Continued)

*Primary Examiner* — John Cooper

(74) *Attorney, Agent, or Firm* — Kilpatrick Townsend & Stockton LLP

(57) ABSTRACT

A rear sight block/barrel assembly for an AK-47 rifle may include a bull barrel and a rear sight block. The bull barrel may include a first portion, a second portion having an outer diameter less than the first portion, and a third portion having an outer diameter less than the second portion. The bull barrel may include a right handed outer diameter threaded portion that extends from the distal end of the bull barrel. The rear sight block may include a body portion including a lower bore configured so the body portion is press fittable onto the second portion of the bull barrel. The body portion may further include a mount portion having a picatinny rail portion and a dovetail portion. The body portion may include a hole for receiving a pin insertable into the hole for securing the gas tube in position relative to the rear sight block.

16 Claims, 8 Drawing Sheets

(56) References Cited

U.S. PATENT DOCUMENTS

| | | | | |
|---|---|---|---|---|
| 8,490,312 | B2 * | 7/2013 | Barrett | F41A 3/26 42/75.02 |
| 9,696,118 | B2 | 7/2017 | Keeney | |
| 9,816,787 | B2 | 11/2017 | Keeney | |
| 2019/0162503 | A1 | 5/2019 | Keeney et al. | |
| 2019/0162504 | A1 | 5/2019 | Keeney et al. | |

OTHER PUBLICATIONS

Ray I., "Acu Tec Arms AK Bull Barrel Assembly," retrieved from https://www.thefirearmblog.com/blog/2019/01125/acta-tec-arms-ak-bull-barrel/, TFB The Firearm Blog, posted Jan. 25, 2019.

* cited by examiner

REAR SIGHT BLOCK AND BARREL FOR A FIREARM

CROSS-REFERENCES TO RELATED APPLICATIONS

This application claims priority to Provisional U.S. Patent Application No. 62/736,364 filed Sep. 25, 2018, entitled "Improved Bull Barrel for a Rifle" and Provisional U.S. Patent Application No. 62/794,153 filed Jan. 18, 2019, entitled "Improved Rear Sight Block for a Rifle." The entire disclosure of both aforementioned Provisional U.S. Patent Applications are hereby incorporated by reference, for all purposes, as if fully set forth herein.

BACKGROUND OF THE INVENTION

The disclosure generally relates to a rear sight block and barrel assembly for AK-type rifles having a rigid rear sight block configured to fit accessories interchangeably and a rigid bull barrel for improved accuracy.

Typically, AK-47 rifles are built one at time and fit with components specific to that rifle, with the components stamped with a matching number, such practice referred to as a "numbers matching kit." These stamped components are generally not interchangeable with other rifles or other rifle components or accessories. Therefore, the conventional AK-47 is limited to using only one type of rear sight, e.g., the iron sight. Also, the conventional AK-47 barrel includes nine step downs in diameter and, therefore, does not qualify as a bull barrel. The numerous step downs of the conventional barrel contribute to many points of flexure that may deleteriously affect accuracy.

BRIEF SUMMARY OF THE INVENTION

A rear sight block/barrel assembly for an AK-47 rifle may include a bull barrel and a rear sight block. The bull barrel may have a proximal end and a distal end. The bull barrel may include a first portion positioned at the proximal end, the first portion having a first outer diameter that is configured so that the first portion is matingly engagable with a receiver assembly. The bull barrel may include a second portion that extends distally from the first portion, the second portion having a second outer diameter that is less than the first outer diameter. The bull barrel may include a third portion that extends distally from the second portion to the distal end of the bull barrel, the third portion having a third outer diameter that is less than the second outer diameter. The bull barrel may include a right handed outer diameter threaded portion that extends from the distal end of the bull barrel. The rear sight block may have a body portion and a mount portion. The body portion may include a lower bore having an inner diameter that is configured so the body portion is press fittable onto the second portion of the bull barrel. The body portion may further include an upper bore configured to receive a gas piston of a bolt carrier. The mount portion may be removably coupled to a top surface of the body portion. The mount portion may include a picatinny rail portion and a dovetail portion. The body portion may include a hole in the upper front body portion for receiving a pin. The pin may be insertable into the hole for securing the gas tube in position relative to the rear sight block, the pin having at least one threaded end.

In some embodiments, the first portion of the bull barrel may be press fit into the receiver assembly. The receiver assembly may include a trunnion having an inner diameter that is less than the first outer diameter of the first portion. The trunnion may be configured to couple the bull barrel to a receiver. The bull barrel may further include a tapered portion between the first portion and the second portion. The third portion of the bull barrel may have an outer diameter of 11/16". The right handed threaded portion of the bull barrel may have 5/8"-24 outer diameter threads. The outer diameter treads may enable the bull barrel to attach to AR-10/.308 accessories including a muzzle break or suppressor. The assembly may further include an iron sight coupled with the dovetail of the mount portion. The mount portion having the picatinny rail portion and the dovetail portion may be of a single piece. The mount portion may be attachable to a plurality of accessories. The plurality of accessories may include an iron sight, laser sights, scope mount, red dot, or combinations thereof.

Embodiments may include a bull barrel for an AK-47 rifle. The bull barrel may have a first end an a second end. The bull barrel may include a rifle coupling portion positioned at the first end and having a first outer diameter. The first outer diameter may be configured so that the rifle coupling portion is matingly engagable with a receiver assembly of the AK-47 rifle. A sight block coupling portion may extend distally from the rifle coupling portion, The sight block coupling portion may have a second outer diameter that is less than the first outer diameter. The sight block coupling portion may be configured to be matingly engage with a rear sight block. The bull barrel may include a main barrel portion that extends distally from the sight block coupling portion to the second end of the bull barrel. The main barrel may have a third outer diameter that is less than the second outer diameter.

In some embodiments, a first step down in diameter may be defined between the rifle coupling portion and the sight block coupling portion. A second step down in diameter may be defined between the sight block coupling portion and the main barrel portion. The bull barrel may have at most the first step down and the second step down. The bull barrel may be devoid of further step downs in diameter. The rifle coupling portion of the bull barrel may be press fit into the receiver assembly. The receiver assembly may include a trunnion having an inner diameter less than the first outer diameter. The trunnion may be configured to couple the bull barrel to a receiver of the AK-47 rifle. The bull barrel may include a tapered portion between the rifle coupling portion and the sight block coupling portion. The third portion may have an outer diameter of 11/16". The second end of the bull barrel may include a right handed threaded portion. The right handed threaded portion may have 5/8"-24 outer diameter threads that enable the bull barrel to attach to AR-10/.308 accessories including a muzzle break or suppressor.

Embodiments may include a rear sight block assembly for an AK-47 rifle. The rear sight block assembly may have a main body and a mounting member. The main body may include a lower bore having an inner diameter configured to press fit onto a rifle barrel. The main body may include an upper bore configured to receive a gas piston of a bolt carrier. The mounting member may be removably coupled to a top surface of the main body. The mounting member may include a first mounting platform that is coupleable with a first rifle accessory in a first manner. The mounting member may include a second mounting platform that is different than the first mounting platform and that is coupleable with a second rifle accessory in a second manner, the second manner being different than the first manner.

In some embodiments, the mounting member is a single component that includes a picatinny rail and a dovetail. The main body may further include a hole in an upper front portion of the main body, the hole being configured to receive a pin to secure the gas tube in position relative to the main body. The rear sight block assembly may further include a pair of fasteners, wherein each fastener is configured to couple with an end of the pin to secure the pin within the hole of the main body.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain the principles of the invention. No attempt is made to show structural details of the invention in more detail than may be necessary for a fundamental understanding of the invention and various ways in which it may be practiced.

Figure 1:
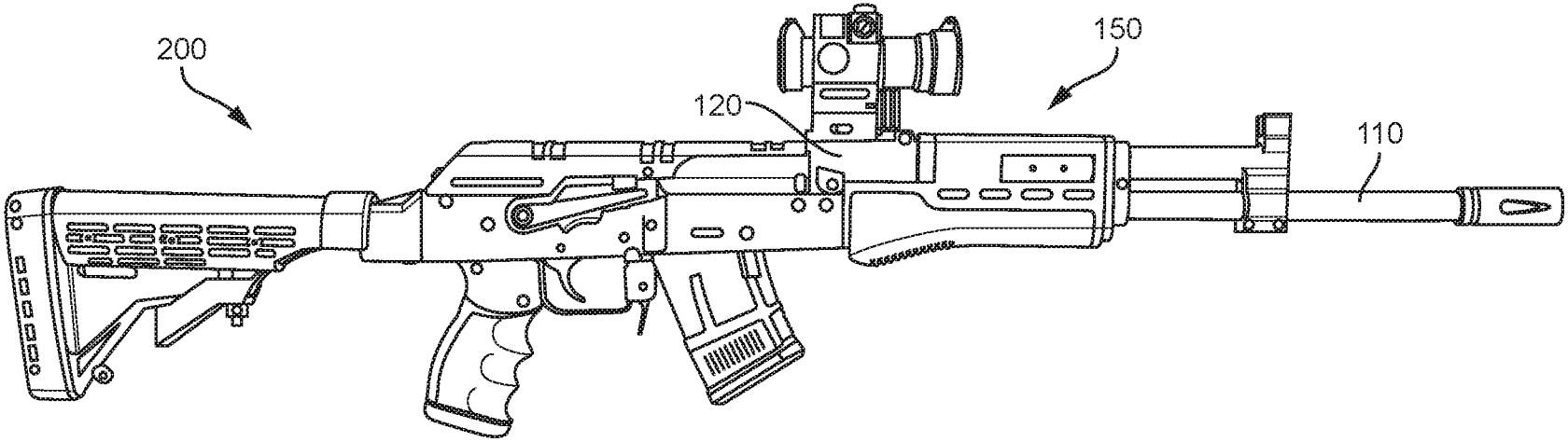
FIG. 1 illustrates a perspective view of a rifle having a barrel assembly including a bull barrel and a rear sight block, according to an embodiment of the present disclosure.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE INVENTION

Various example embodiments of the present disclosure will be described below with reference to the drawings constituting a part of the description. It should be understood that, although terms representing directions are used in the present disclosure, such as "front", "rear", "upper", "lower", "left", "right", and the like, for describing various exemplary structural parts and elements of the present disclosure, these terms are used herein only for the purpose of explanation and are determined based on the orientations shown in the drawings. Since the embodiments disclosed by the present disclosure can be arranged according to different directions, these terms representing directions are merely used for illustration and should not be regarded as limiting. Wherever possible, the same or similar reference marks used in the present disclosure refer to the same components.

Unless defined otherwise, all technical terms used herein have the same meanings as commonly understood by one of ordinary skill in the art to which the invention pertains. The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law. Moreover, it is noted that like reference numerals reference similar parts throughout the several views of the drawings.

Embodiments of the present disclosure provide a barrel assembly for an AK-47 including a bull barrel and a rear sight block for improved accuracy and for interchangeability with modern rifle accessories. These modern accessories include open fixed sights, scopes, red dots, lasers, and the like. The bull barrel is achieved via minimizing the step downs for the inner diameter to provide improved rigidity over conventional barrels, which have nine step downs in diameter creating numerous points of flexure. The rear sight block is fixed securely to the bull barrel in the barrel assembly of the disclosure and includes a removable mount portion having both a dovetail and a picatinny. The mount portion having both a dovetail and picatinny provides for mating the AK-47 rifle with multiple modern accessory components not attachable to conventional AK-47 rifles. These modern accessories include open fixed sights, scopes, red dots, lasers, and the like. Having briefly described various features of the barrel assembly, additional aspects will be readily recognized in reference to the description of the various figures provided herein below.

Figure 2A:
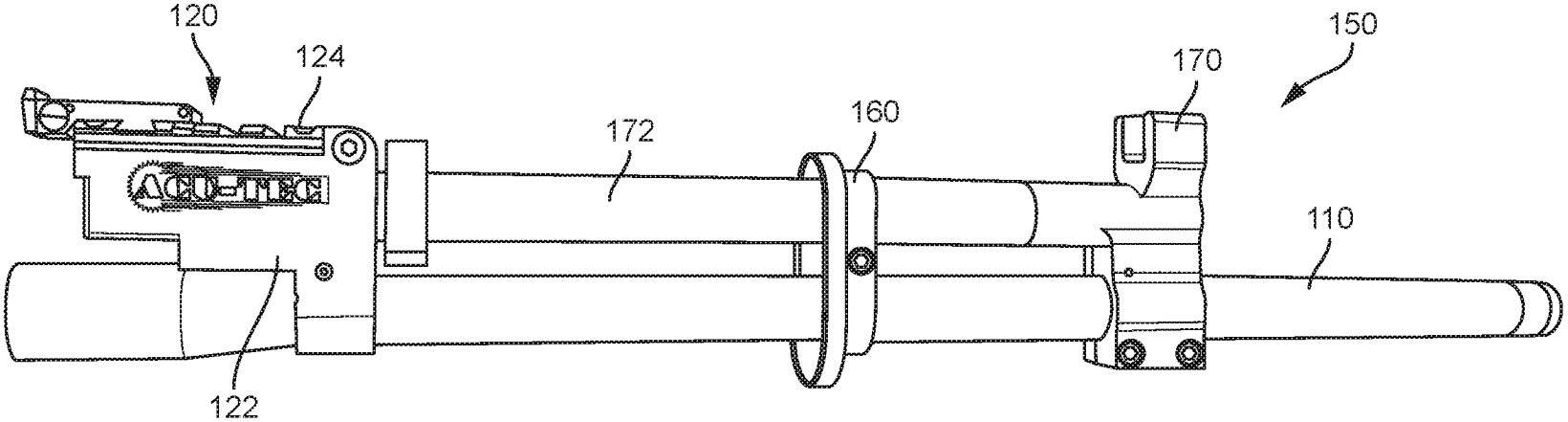
FIG. 2A illustrates a perspective view of the barrel assembly of FIG. 1 including a bull barrel and a rear sight block and further including a front sight and a gas block.

Turning now to FIG. 1, illustrated is a perspective view of a rifle 100 having a barrel assembly 150. Rifle 100 is an AK-47 type firearm to which the conventional barrel and rear sight block have been removed and replaced by barrel assembly 150. Barrel assembly 150 includes a bull barrel 110 and a rear sight block 120. FIG. 2A illustrates a perspective view image of the barrel assembly 150 of FIG. 1 including bull barrel 110 and rear sight block 120. Rear sight block 120 includes a body portion 122 and a removable mount portion 124. Mount portion 124 allows the rear sight block 120 to simultaneously couple or attach to multiple components or accessories including modern components and traditional or conventional components. For example, mount portion 124 enables the rear sight block 120 to simultaneously couple with a conventional iron sight 175 and with modern accessories, such as a red dot. Barrel assembly 150 may be comprised of steel, for example, 4150 steel or other suitable material. Also illustrated is front gas block 160 and sight 170, which are fixedly attached to barrel 110 to provide rigidity. Front sight 170 uses a standard automatic rifle (AR) front sight pin.

Figure 2B:
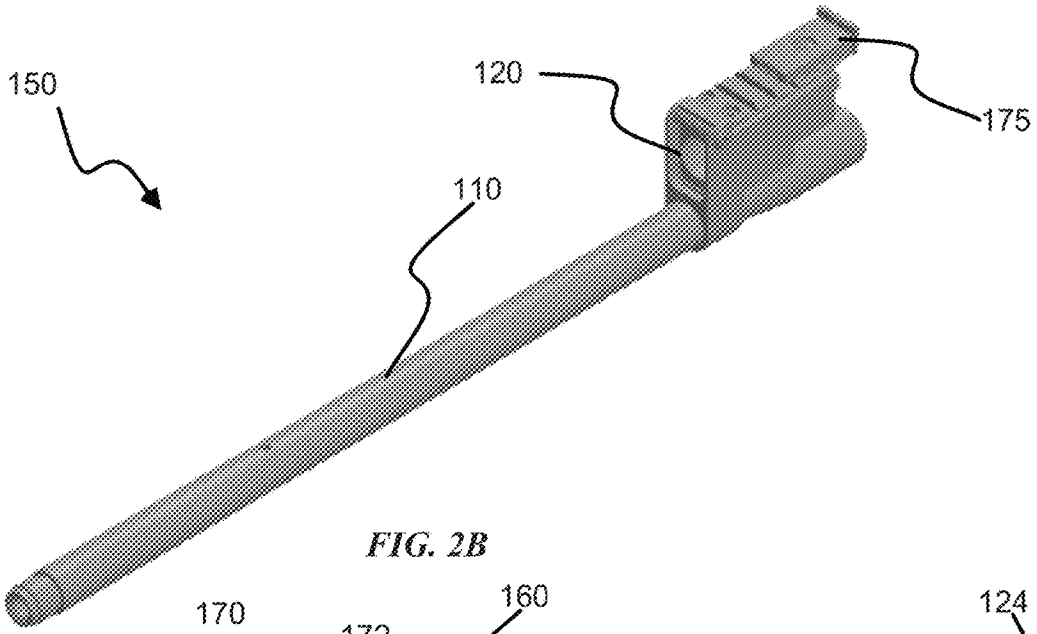
FIG. 2B illustrates an assembled, perspective view of the barrel assembly having a bull barrel and a rear sight block of FIG. 1.
Figure 2C:
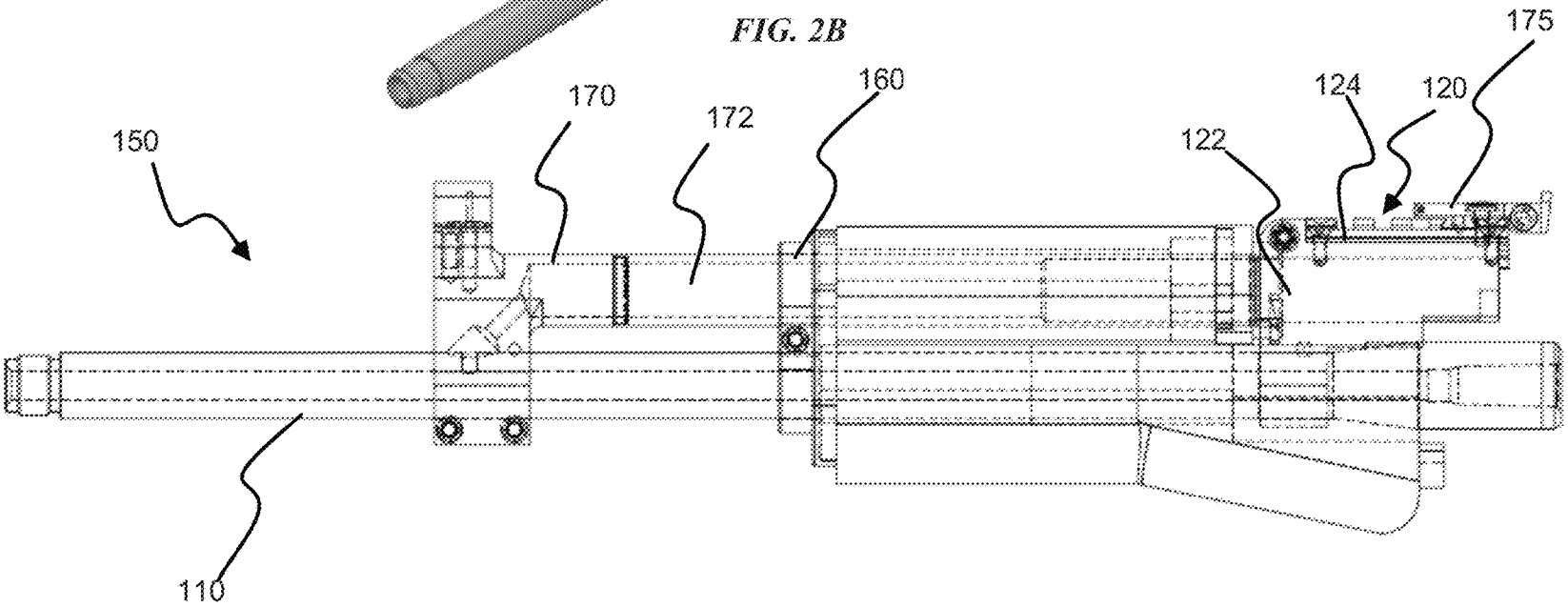
FIG. 2C illustrates an assembled, side view of the barrel assembly of FIG. 1.

Barrel assembly 150 is further illustrated, as assembled, in perspective view FIG. 2B showing bull barrel 110 and rear sight block 120, which are matingly press fit or interference fit together. FIG. 2C illustrates an assembled, side view of the barrel assembly 150 showing rear sight block 120 assembled to bull barrel 110, further including front gas block 160 and sight 170, which are slid over the barrel and fixedly attached with two screws to reduce misalignment issues common to conventional AK-47 type rifles. Rear sight block 120 includes body portion 122 and removable mount portion 124. Iron sight 175 is shown attached to mount portion 124.

Figure 3:
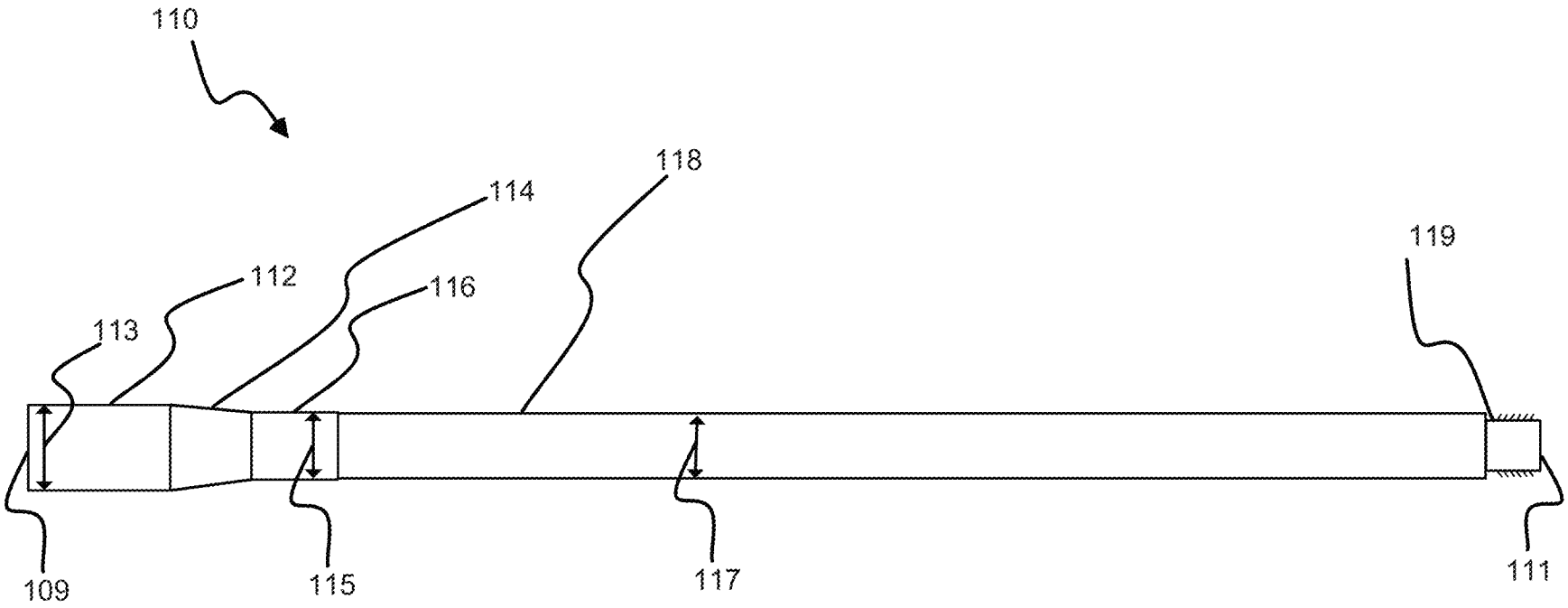
FIG. 3 illustrates a side view of the bull barrel of FIG. 1.

FIG. 3 illustrates a side view of bull barrel 110. Barrel 110 includes a first portion 112 having a first end 109 and a first outer diameter 113. Portion 112 having outer diameter 113 is configured to be matingly engagable with a receiver assembly (not shown). The outer diameter 113 has a minimum 0.001 press fit/interference fit over the inside diameter of a front trunnion to secure the barrel to the receiver. Barrel 110 includes a second portion having 116 a second outer diameter 115, which is less than the first outer diameter 113. Second portion 116 having outer diameter 115 is configured so that a lower bore of rear sight block 120 is pressed on to the barrel, with a minimum 0.001 press fit/interference fit over the inside diameter of the rear sight block lower bore to secure the rear sight block 120 to the barrel 110. Bull barrel 110 may further include a tapered portion 114 between the first portion 112 and the second portion 116. Barrel 110 includes a third portion 118 extending to a second end 111. Third portion 118 has a third outer diameter 117 that is less than the second outer diameter 115. In some embodiments, the first portion 112 may have an outer diameter of about 0.9", or about 0.91", or about 0.9055", or about 0.9060", or about 0.9065", or about 0.9070", or about 0.9075", or about 0.9080", or about 0.9085". In some embodiments the first portion 112 may have a length of about 1.50". In some embodiments, the second portion 116 may have a length of from about 0.5" to about 1.0" or a length of from about 0.7" to about 0.8". In some embodiments, the second portion 116 may have a length of about 0.5", or about 0.6", or about 0.7", or about 0.75", or about 0.77", or about 0.775", or about 0.78", or about 0.8", or about 0.9", or about 0.9". In some embodiments, the first portion 112, the second portion 116, and the tapered portion 114 may have a total length of about 3.165". In some embodiments, the second portion 116 may have an outer diameter of about 0.69", or about 0.690", or about 0.691", or about 0.6900", or about 0.6905", or about 0.6910". In some embodiments, the first portion 112, the second portion 116, the tapered portion 114, and the third portion 118 may have a total length of about 15.730". In some embodiments, the first portion 112, the second portion 116, the tapered portion 114, the third portion 118, and the end portion 111 including right handed threaded portion 119 may have a total length of about 16.300", which may correspond to the total length of bull barrel 110. In some embodiments, the third portion 118 may have an outer diameter of about 0.69", or about 0.685", or about 0.686", or about 0.687", or about 0.688", or about 0.689". The third portion 118 may have an inner diameter of about 0.156".

Portion 118 having outer diameter 117 is as large as possible while being able to provide relief for the rear sight block 120 to easily slide into press position at portion 116. In some embodiments, the third portion 118 may have an outer diameter of about 0.69", or about 0.685", or about 0.686", or about 0.687", or about 0.688", or about 0.689". Barrel 110 is a bull barrel based in part on the diameter 117 of portion 118 since the barrel does not taper outward and is cylindrical. For example, bull barrel 110 may have an inner diameter of about 11/16" for the full length of the barrel portion 118. End 111 includes a right handed threaded portion 119 having threads on the outer diameter, which may consist of 5/8"-24 outer diameter right handed threads that enable the bull barrel to be used with modern accessories available off the shelf, such as a standard AR-10/.308 accessories including muzzle breaks or flash suppressors. In contrast, conventional AK-47 barrels employ left hand threads that are not interchange with sought after modern accessories such as suppressors.

Figure 4:
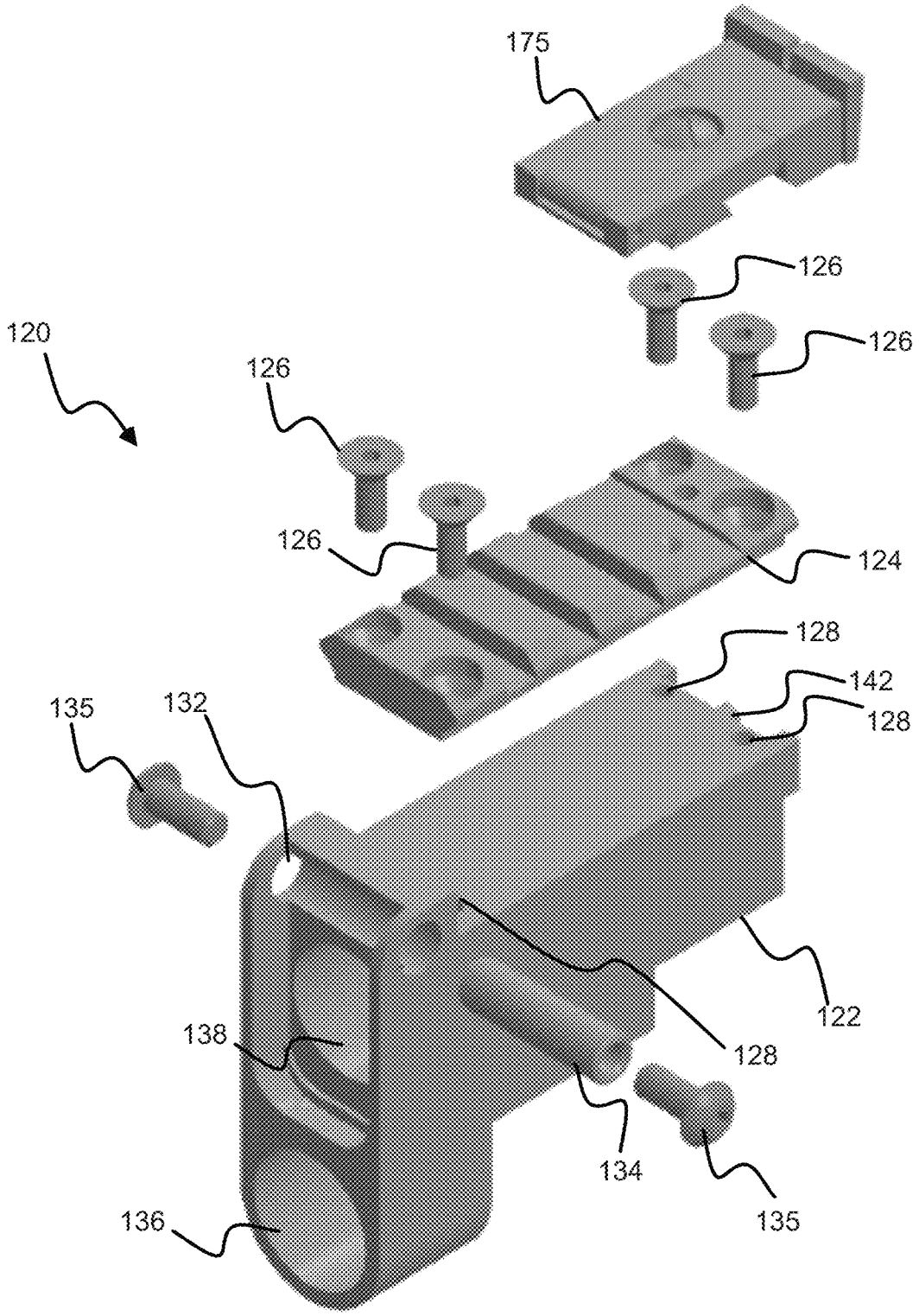
FIG. 4 illustrates an exploded view of the rear sight block of FIG. 1 and further including optional iron sight.

FIG. 4 illustrates an exploded view of the rear sight block of FIG. 1 shown further including optional iron sight 175. Rear sight block 120 has a body portion 122 and a removable mount portion 124, which may be fixedly attached to the body portion 122 by inserting screws 126 into holes 128. The mount portion 124 includes multiple mounting features or platforms that are different from one another and that are configured to mount or couple with accessories in different manners. Specifically, the mount portion 124 includes both a dovetail 130 and a picatinny 140 (see also FIGS. 7A and 7B) for mounting accessories such as rear sights, scope mounts, red dots, and the like. One of the mounting platforms (e.g., dovetail 130) may allow an accessory or component to attach to the mount portion 124 in a first manner, such as by inserting or sliding the accessory laterally into the mounting feature, while the other mounting platform (e.g., picatinny 140) allows an accessory or component to attach to the mount portion 124 in a second manner, such as by inserting or clipping the accessory over the mounting platform.

Figure 8A:
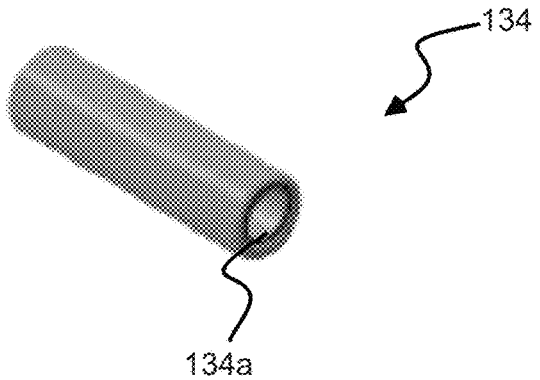
FIG. 8A illustrates a perspective view of the gas tube latch pin of the rear sight block of FIG. 4.
Figure 8B:
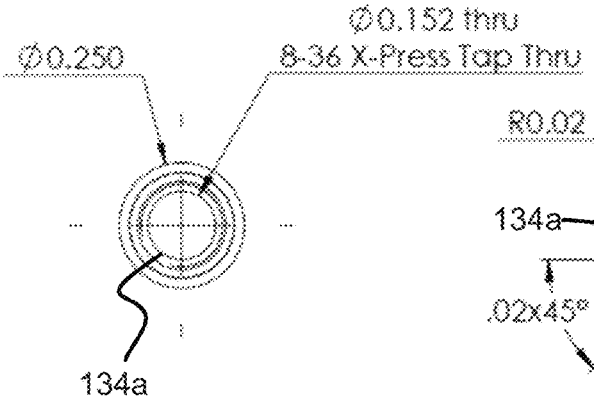
FIGS. 8B and 8C illustrate front and side views, respectively, of the gas tube latch pin of the rear sight block of FIG. 4.
Figure 8C:
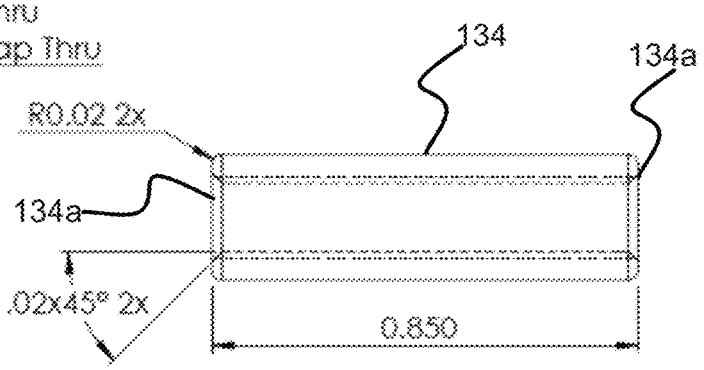

The rear sight block body portion 122 includes a hole 132 for inserting a gas tube latch pin 134 for securing a gas tube (see also FIGS. 8A-8C). Pin 134 has at least one end secured with a threaded fastening element 135. Gas tube latch pin 134 replaces conventional gas tube cam locks, which may flip up and down, are cumbersome, and are prone to breakage. For example the conventional gas tube cam lock may break off a missing bolt cam pin causing failure to lock. Conventional gas tube cam locks are also less effective at securing the rear sigh block to the gas tube. Specifically, the gas tube cam locks may allow some minor movement between the gas tube and rear sight block, which negatively impacts the performance of the firearm. In contrast, gas tube latch pin 134 tightly secures body portion 122 to a gas tube. The gas tube latch pin 134 does not include components that require the component to be flipped up and down and thus, the gas tube latch pin 134, is less prone to breakage. The gas tube latch pin 134 also does not include components that are susceptible to being broken off, which would cause failure to lock. The gas tube latch pin 134 is designed to be inserted within the hole and secured on one end, or both ends, with the fastening element 135 to tightly secure the gas tube to the rear sight block 120. As illustrated, the body portion 122 includes bore 136 for press or interference fitting with the second portion 116 of bull barrel 110 and also include bore 138 having sufficient clearance for a gas piston of a bolt carrier. As illustrated in FIG. 2C, the gas tube 172 extends distally of a distal end of the rear sight block and is coupled with the rear sight block via the gas tube latch pin 134. Body portion 122 further includes a protrusion 142 (see also FIG. 5).

Figure 5:
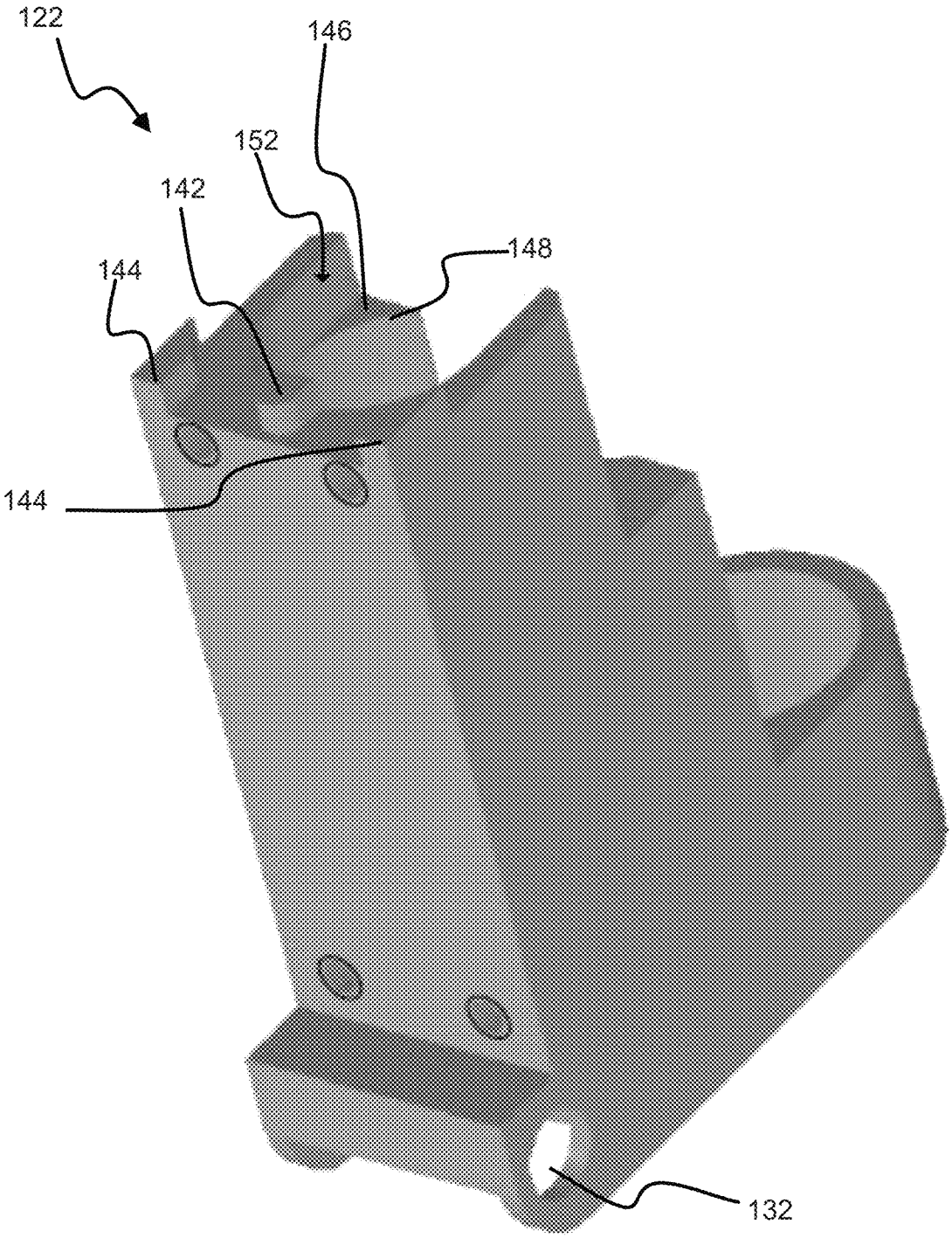
FIG. 5 illustrates a perspective top view of the rear sight block of FIG. 4 showing a horse-shoe shaped recess for receiving and locking in a dust cover.

FIG. 5 illustrates a top perspective view of the rear sight block of FIG. 4 showing protrusion 142, which is aligned with protrusions 144, and functions cooperatively with protrusions 144 to couple a dust cover over a receiver and bolt carrier positioned proximally of the rear sight block. The protrusions, 142 and 144, are employed in locking the dust cover over the receiver. Body portion 122 also has a horse-shoe shaped recess 152, which provides clearance and enables the rear sight block to fit over a front trunnion. Front surface 146 and arcuate edge 148 more securely couple the front trunnion and bolt carrier with the rear sight block 120, which provides a more secure fit of the rear sight block 120 and bolt carrier in comparison with conventional rear sight blocks that employ rectangular shaped recesses. The edge 148 extends longitudinally through the rear sight block 120 and defines the cylindrical bore 138 through which the gas piston of the bolt carrier is inserted. The cylindrical bore 138 provides a more secure fit for bolt carrier. The rear sight block 120 may similarly increase contact with the other components of the rifle, which provides for an increased secure fit and greater accuracy and performance of the firearm.

Figure 6A:
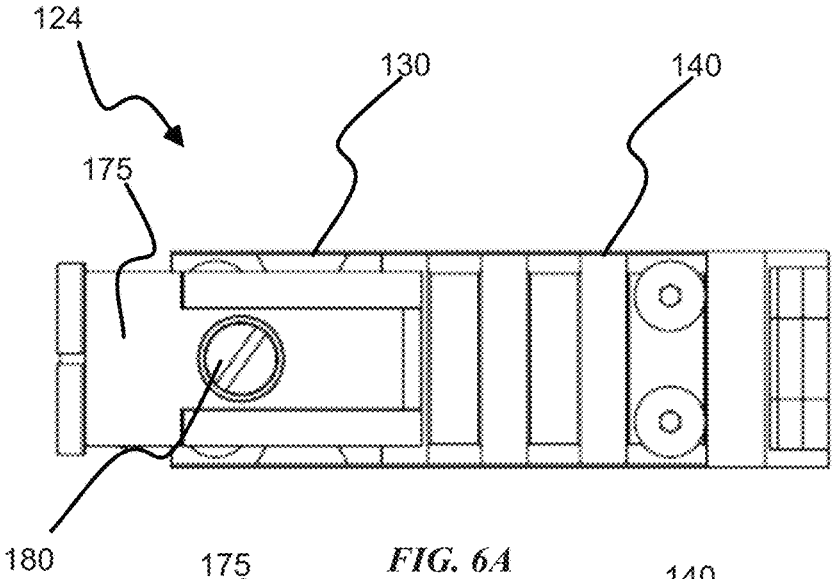
FIG. 6A illustrates a top view of the of the rear sight block of FIG. 4 and further including optional iron sight.
Figure 6B:
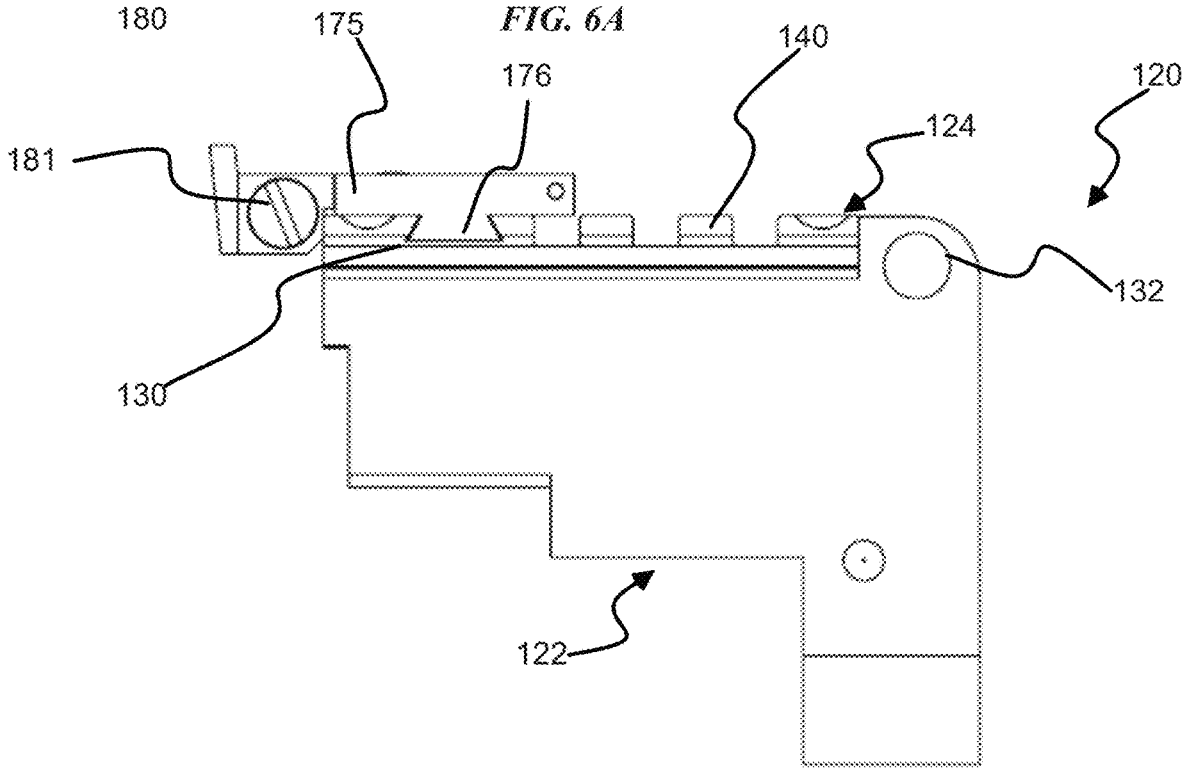
FIG. 6B illustrates a side view of the of the rear sight block of FIG. 4 and further including optional iron sight.

FIG. 6A illustrates a top view of the of the rear sight block of FIG. 4 showing the top view of mount portion 124 of a rear sight block with an optional iron sight 175 attached to the dovetail portion 130. Mount portion 124 further includes a picatinny portion 140 having three rectangular slots (see also FIG. 7B). Fastener 180 provides elevation adjustment for the iron sight 175 and fastener 181 provides windage adjustment for the iron sight 175. Fasteners 180 and 181 may be a bolt, screw, or any other component that is known in the art for adjusting elevation and windage. Fastener 180 presses against a top surface of the mount portion to adjust the elevation of the iron sight 175 relative to the mount portion 124 and fastener 181 similarly presses on a side of the mount portion 124 to adjust for windage. FIG. 6B illustrates a side view of the of the rear sight block of FIG. 4 showing the optional iron sight 175 attached to the dovetail portion 130 of mount portion 124. Mount portion also includes picatinny portion 140. Body portion 122 includes a hole 132 for inserting a gas tube latch pin (see also FIGS. 8A-8C).

Figure 7A:
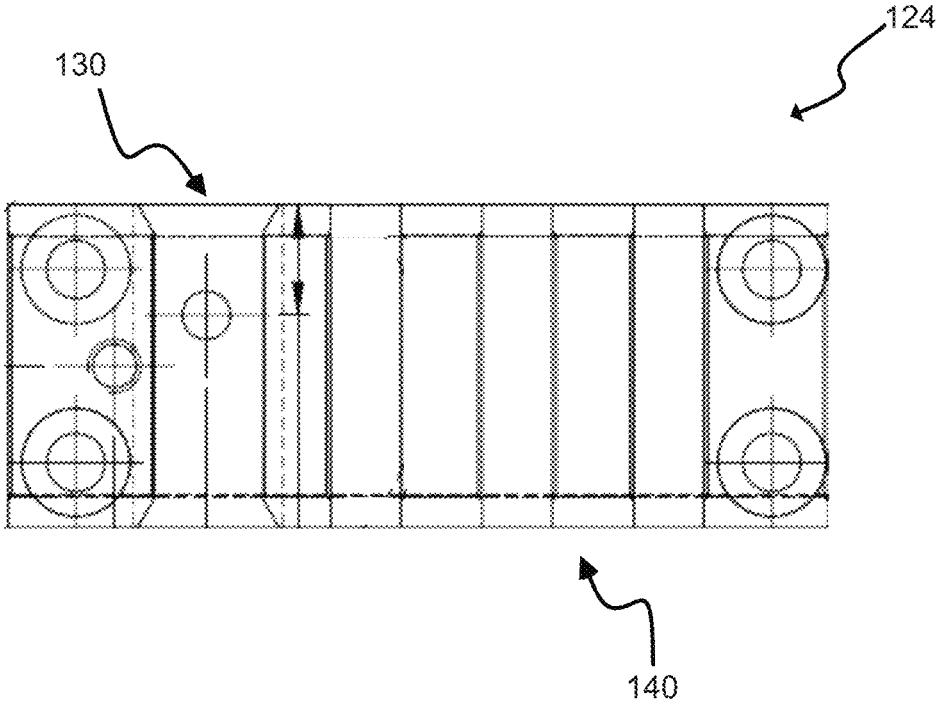
FIG. 7A illustrates a top view of the mount portion of the rear sight block of FIG. 4.
Figure 7B:
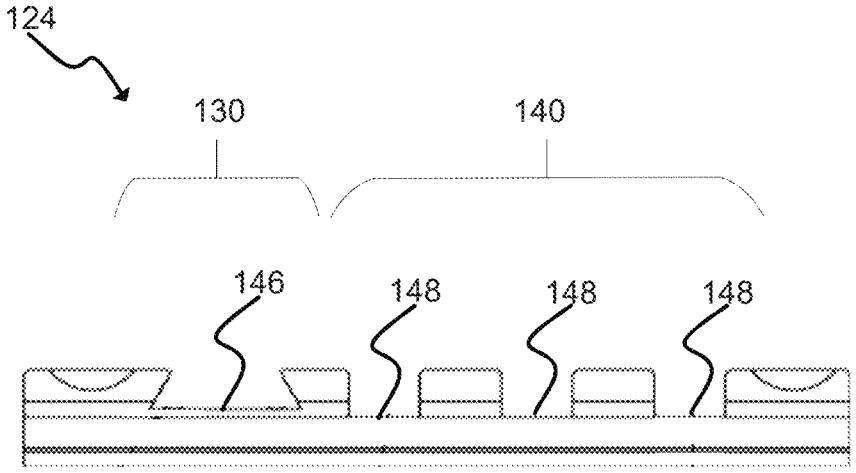
FIG. 7B illustrates a side view of the mount portion of the rear sight block of FIG. 4.

FIG. 7A illustrates a top view of the mount portion 124 of the rear sight block 120 of FIG. 4. Dovetail portion 130 has a tapered slot 146 for mounting an accessory such as iron sight 175. Iron sight 175 includes a protrusion or tail 176 (see FIG. 6A) that is shaped and sized to correspond to the tapered slot 146. The iron sights protrusion 176 allows the iron sight 175 to slide into mating engagement with the mount portion 124 to secure the iron sight 175 to the rear sight block 120. Picatinny portion 140 includes a plurality of rectangular slots 148, such as three slots 148 illustrated in a side view of the mount portion of the rear sight block as in FIG. 7B, which may be used for mounting an accessory such as a standard red dot. Various accessories such as rear sights, scope mounts, red dots, and the like are envisioned for mounting on the mount portion. Advantageously, the mount portion 124 provides many options for simultaneously attaching at least two accessories to the rear sight block 120 and also provides many options for attaching interchangeable modern accessories.

FIG. 8A illustrates a perspective view of the gas tube latch pin 134 of the rear sight block of FIG. 4. FIGS. 8B and 8C illustrate front and side views, respectively, of the gas tube latch pin 134. At least one end of gas tube latch pin 134 is a threaded end 134*a*. In some embodiments, both ends 134*a* of gas tube latch pin 134 are threaded to receive threaded fastening elements 135 (as shown in FIG. 4). Pin 134 may have an inner diameter of about 0.152" and an outer diameter of about 0.250". The length of pin 134 may be about 0.850". The gas tube (not shown) may be made of Drawn-over-mandrel (DOM) tubing such as mild steel, chromoly or another alloy, such as SAE 1020 or 1026 steel or other tubing as known in the art.

Having described several example configurations, various modifications, alternative constructions, and equivalents may be used without departing from the spirit of the disclosure. For example, the above elements may be components of a larger system, wherein other rules may take precedence over or otherwise modify the application of the technology. Also, a number of steps may be undertaken before, during, or after the above elements are considered. Accordingly, the above description does not bind the scope of the claims.

As used herein and in the appended claims, the singular forms "a", "an", and "the" include plural references unless the context clearly dictates otherwise. Thus, for example, reference to "a user" includes a plurality of such users, and reference to "the processor" includes reference to one or more processors and equivalents thereof known to those skilled in the art, and so forth.

Also, the words "comprise", "comprising", "contains", "containing", "include", "including", and "includes", when used in this specification and in the following claims, are intended to specify the presence of stated features, integers, components, or steps, but they do not preclude the presence or addition of one or more other features, integers, components, steps, acts, or groups.

What is claimed is:

1. A rear sight block/barrel assembly for an AK-47 rifle, the assembly comprising:

a bull barrel having a proximal end and a distal end, the bull barrel including:

a first portion positioned at the proximal end, the first portion having a first outer diameter that is configured so that the first portion is matingly engagable with an AK-47 rifle receiver assembly;

a second portion that extends distally from the first portion, the second portion having a second outer diameter that is less than the first outer diameter;

a third portion that extends distally from the second portion to the distal end of the bull barrel, the third portion having a substantially constant third outer diameter that is less than the second outer diameter; and a threaded portion that extends from the distal end of the bull barrel; and a rear sight block having:

a body including a lower bore having an inner diameter that is configured so the body is press fittable onto the second portion of the bull barrel, the body further including an upper bore configured to receive a gas tube of a bolt carrier;

a mount removably coupled to a top surface of the body, the mount including a Picatinny rail and a dovetail; and a hole in an upper front portion of the body for receiving a pin, the pin insertable into the hole and configured to secure the gas tube in position relative to the rear sight block, the pin having at least one threaded end.

2. The rear sight block/barrel assembly of claim 1, wherein the first portion of the bull barrel is press fit into the AK-47 receiver assembly, the AK-47 receiver assembly including a trunnion having an inner diameter that is less than the first outer diameter of the first portion, the trunnion being configured to couple the bull barrel to the AK-47 receiver.

3. The rear sight block/barrel assembly of claim 1, the bull barrel further comprising a tapered portion between the first portion and the second portion.

4. The rear sight block/barrel assembly of claim 1, wherein the third portion has an outer diameter of 11/16".

5. The rear sight block/barrel assembly of claim 1, wherein the threaded portion consists of 5/8"-24 outer diameter threads.

6. The rear sight block/barrel assembly of claim 5, further comprising an iron sight that is coupled with the dovetail of the mount.

7. The rear sight block/barrel assembly of claim 1, wherein the mount including the Picatinny rail and the dovetail is comprised of a single piece.

8. The rear sight block/barrel assembly of claim 1, wherein the mount is attachable to a plurality of accessories, the plurality of accessories includes an iron sight, laser sights, scope mount, red dot, or combinations thereof.

9. An AK-47 rifle bull barrel, the bull barrel having a first end an a second end, the bull barrel comprising:

a rifle coupling portion positioned at the first end and having a first outer diameter, the first outer diameter being configured so that the rifle coupling portion is matingly engagable with a receiver assembly of the AK-47 rifle;

a sight block coupling portion that extends distally from the rifle coupling portion, the sight block coupling portion having a second outer diameter that is less than the first outer diameter, the sight block coupling portion being configured to be matingly engage with a rear sight block; and a main barrel portion that extends distally from the sight block coupling portion to the second end of the bull barrel, the main barrel having a substantially constant third outer diameter that is less than the second outer diameter.

10. The bull barrel of claim 9, wherein a first step down in diameter is defined between the rifle coupling portion and the sight block coupling portion and a second step down in diameter is defined between the sight block coupling portion and the main barrel portion.

11. The bull barrel of claim 10, wherein the bull barrel has at most the first step down and the second step down, and the bull barrel is devoid of further step downs in diameter.

12. The bull barrel of claim 9, wherein the rifle coupling portion of the bull barrel is configured to be press fit into an AK-47 rifle receiver assembly, the AK-47 rifle receiver assembly including a trunnion having an inner diameter less than the first outer diameter, the trunnion configured to couple the bull barrel to a receiver of the AK-47 rifle.

13. The bull barrel of claim 9 further comprising a tapered portion between the rifle coupling portion and the sight block coupling portion.

14. The bull barrel of claim 9, wherein the third portion has an outer diameter of 11/16".

15. The bull barrel of claim 9, wherein the second end of the bull barrel includes a threaded portion.

16. The bull barrel of claim 15, wherein the threaded portion consists of 5/8"-24 outer diameter threads.

* * * * *